US010132132B2

(12) United States Patent
Robottom

(10) Patent No.: US 10,132,132 B2
(45) Date of Patent: Nov. 20, 2018

(54) RUNNING TOOL WITH INDEPENDENT HOUSING ROTATION SLEEVE

(71) Applicant: Cameron International Corporation, Houston, TX (US)

(72) Inventor: Gavin Paul Robottom, Leeds (GB)

(73) Assignee: Cameron International Corporation, Houston, TX (US)

( * ) Notice: Subject to any disclaimer, the term of this patent is extended or adjusted under 35 U.S.C. 154(b) by 495 days.

(21) Appl. No.: 14/853,893

(22) Filed: Sep. 14, 2015

(65) Prior Publication Data

US 2016/0069150 A1 Mar. 10, 2016

Related U.S. Application Data

(63) Continuation of application No. 13/582,990, filed as application No. PCT/US2010/061923 on Dec. 22, 2010, now Pat. No. 9,133,679.

(30) Foreign Application Priority Data

Feb. 17, 2010 (EP) ..... 10153868

(51) Int. Cl.
*E21B 33/04* (2006.01)
*E21B 23/00* (2006.01)
(Continued)

(52) U.S. Cl.
CPC ..... *E21B 33/0422* (2013.01); *E21B 23/006* (2013.01); *E21B 33/04* (2013.01);
(Continued)

(58) Field of Classification Search
CPC ..... E21B 23/004; E21B 23/006; E21B 23/01; E21B 33/04; E21B 33/0407;
(Continued)

(56) References Cited

U.S. PATENT DOCUMENTS 3,543,847 A * 12/1970 Haeber ..... E21B 33/043 166/115
3,625,283 A * 12/1971 Ahlstone ..... E21B 33/043 166/330
(Continued)

FOREIGN PATENT DOCUMENTS

EP 0535277 A1 4/1993
GB 2044863 A 10/1980

OTHER PUBLICATIONS

Singapore Search Report and Written Opinion for SG Application No. 2013058672, dated Aug. 28, 2015.
(Continued)

*Primary Examiner* — Blake E Michener
(74) *Attorney, Agent, or Firm* — Fletcher Yoder, P.C.

(57) ABSTRACT

A system, in certain embodiments, includes a housing running tool including an inner sleeve having a first mating surface configured to engage a second mating surface of a housing to rigidly couple the inner sleeve to the housing. The housing running tool also includes an outer sleeve disposed about the inner sleeve and configured to support the inner sleeve in an axial direction. The outer sleeve includes a first mounting feature configured to engage a second mounting feature of the housing such that substantially all torque applied to the housing running tool in a circumferential direction is transferred to the housing via the outer sleeve.

25 Claims, 10 Drawing Sheets

(51) Int. Cl.

| | |
|---|---|
| ***E21B 33/14*** | (2006.01) |
| ***E21B 34/14*** | (2006.01) |
| *E21B 33/043* | (2006.01) |
| *E21B 43/10* | (2006.01) |

(52) U.S. Cl.
CPC ..... *E21B 33/146* (2013.01); *E21B 34/14* (2013.01); *E21B 33/043* (2013.01); *E21B 43/101* (2013.01)

(58) Field of Classification Search
CPC ..... E21B 33/0415; E21B 33/0422; E21B 33/043; E21B 33/047
See application file for complete search history.

(56) References Cited

U.S. PATENT DOCUMENTS

| | | | | | |
|---|---|---|---|---|---|
| 3,688,841 | A * | 9/1972 | Baugh | E21B 33/047 | 166/89.2 |
| 3,741,294 | A | 6/1973 | Morrill | | |
| 3,885,625 | A * | 5/1975 | Ahlstone | E21B 33/043 | 166/181 |
| 3,913,670 | A * | 10/1975 | Ahlstone | E21B 33/043 | 166/182 |
| 4,355,825 | A * | 10/1982 | Leicht | E21B 33/043 | 166/115 |
| 4,615,544 | A * | 10/1986 | Baugh | E21B 33/043 | 166/348 |
| 4,712,621 | A * | 12/1987 | Wightman | E21B 33/043 | 166/123 |
| 4,736,799 | A | 4/1988 | Ahlstone | | |
| 4,856,592 | A * | 8/1989 | Van Bilderbeek | E21B 33/043 | 166/285 |
| 4,903,776 | A * | 2/1990 | Nobileau | E21B 33/043 | 166/182 |
| 4,928,769 | A * | 5/1990 | Milberger | E21B 33/043 | 166/182 |
| 4,938,289 | A | 7/1990 | Van Bilderbeek | | |
| 4,979,566 | A * | 12/1990 | Hosie | E21B 33/043 | 166/285 |
| 5,439,061 | A | 8/1995 | Brammer et al. | | |
| 5,653,289 | A | 8/1997 | Hosie et al. | | |
| 6,095,243 | A * | 8/2000 | Van Bilderbeek | E21B 33/043 | 166/208 |
| 8,286,711 | B2 * | 10/2012 | Neto | E21B 33/04 | 166/123 |
| 8,567,493 | B2 * | 10/2013 | June | E21B 23/00 | 166/208 |
| 8,668,004 | B2 * | 3/2014 | June | E21B 23/00 | 166/319 |
| 9,580,986 | B2 * | 2/2017 | Kuo | E21B 33/038 | |
| 2011/0226490 | A1 * | 9/2011 | Nguyen | E21B 33/035 | 166/382 |
| 2012/0018171 | A1 | 1/2012 | Robottom et al. | | |
| 2012/0285678 | A1 | 11/2012 | Thornburrow et al. | | |
| 2012/0305269 | A1 | 12/2012 | Bolles et al. | | |
| 2015/0260001 | A1 * | 9/2015 | Kuo | E21B 33/038 | 166/351 |

OTHER PUBLICATIONS

PCT International Search Report and Written Opinion for PCT/US2010/061923, dated Feb. 4, 2011.
European Search Report for EP10153868, dated Jul. 27, 2010.
SG Search and Examination Report; Application No. SG 2013058672; dated Jun. 2, 2016; 6 pages.

* cited by examiner

RUNNING TOOL WITH INDEPENDENT HOUSING ROTATION SLEEVE

CROSS REFERENCE TO RELATED APPLICATIONS

This application claims priority to U.S. Non-Provisional application Ser. No. 13/582,990 entitled "Running Tool With Independent Housing Rotation Sleeve", filed on Sep. 5, 2012, which is herein incorporated by reference in its entirely, and which claims priority to PCT Application No. PCT/US2010/061923 entitled "Running Tool With Independent Housing Rotation Sleeve", filed on Dec. 22, 2010, which is herein incorporated by reference in its entirely, and which claims priority to European Patent Application No. EP10153868.4, entitled "Running Tool With Independent Housing Rotation Sleeve", filed on Feb. 17, 2010, which is herein incorporated by reference in its entirety.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

As will be appreciated, oil and natural gas have a profound effect on modern economies and societies. Indeed, devices and systems that depend on oil and natural gas are ubiquitous. For instance, oil and natural gas are used for fuel in a wide variety of vehicles, such as cars, airplanes, boats, and the like. Further, oil and natural gas are frequently used to heat homes during winter, to generate electricity, and to manufacture an astonishing array of everyday products.

In order to meet the demand for such natural resources, companies often invest significant amounts of time and money in searching for and extracting oil, natural gas, and other subterranean resources from the earth. Particularly, once a desired resource is discovered below the surface of the earth, drilling and production systems are often employed to access and extract the resource. These systems may be located onshore or offshore depending on the location of a desired resource. Further, such systems generally include a wellhead assembly through which the resource is extracted. These wellhead assemblies may include a wide variety of components, such as various casings, hangers, valves, fluid conduits, and the like, that control drilling and/or extraction operations.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

Figure 1:
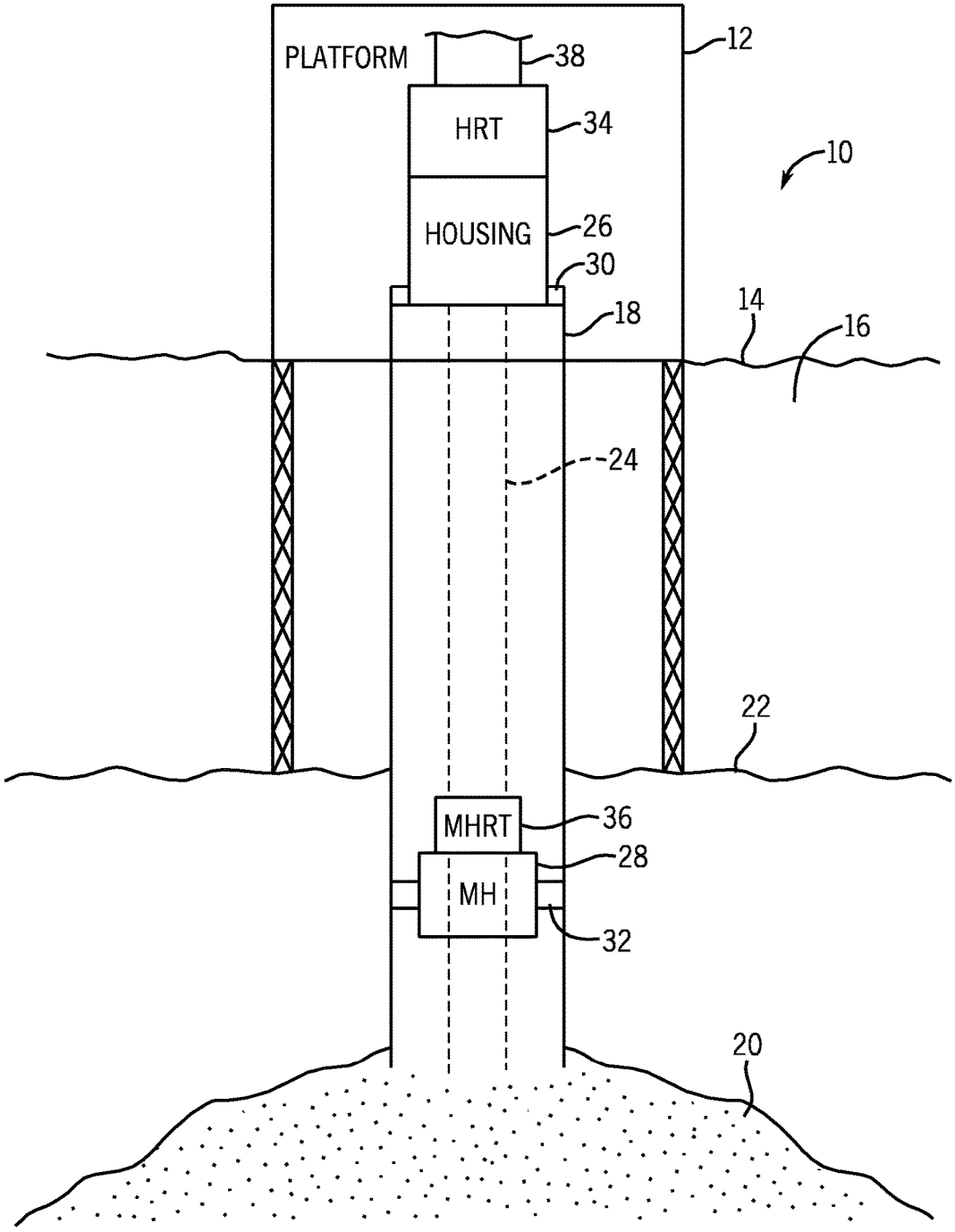
FIG. 1 is a block diagram that illustrates a mineral extraction system in accordance with certain embodiments of the present technique.

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

Certain mineral extraction systems configured for subsea operation employ a housing to support a casing which extends between a jackup rig or platform drilled rig and the sea floor. At the sea floor, a mudline hanger serves to support the casing from the sea floor to the mineral deposit. As will be appreciated, both the housing and mudline hanger are run (e.g., lowered toward the sea floor) by running tools. For example, a housing running tool may be employed to run the housing, and a mudline hanger running tool may be employed to run the mudline hanger. Once the housing and mudline hanger are landed, cement may be injected between casings within a region below the sea floor. To ensure that cement does not interfere with operation of the mudline hanger running tool, drilling fluid may be injected into the casing to remove cement build-up. In certain configurations, the mudline hanger running tool may be coupled to the mudline hanger by a threaded connection. In such configurations, the mudline hanger running tool may be rotated to partially uncouple the tool from the mudline hanger, thereby exposing wash ports which facilitate a flow of drilling fluid between casings to remove excess cement. Once the cement has been removed, the mudline hanger running tool may be rotated in the opposite direction to re-couple the tool to the mudline hanger.

As will be appreciated, the mudline hanger running tool may be driven to rotate by rotation of the housing running tool. In certain embodiments, the housing running tool is coupled to the housing by a threaded connection. For example, the threaded connection may be configured to couple the tool to the housing via left-hand rotation of the tool, and to decouple the tool from the housing via right-hand rotation of the tool. Conversely, the threaded connection between the mudline hanger running tool and the mudline hanger may be configured to couple the tool to the hanger via right-hand rotation of the tool, and to decouple the tool from the hanger via left-hand rotation of the tool. In such a configuration, the housing running tool is rotated in a right-hand direction to re-couple the mudline hanger running tool to the mudline hanger after the cement removal process is complete, thereby closing the wash ports. However, if the torque required to close the wash ports is greater than the torque which couples the housing running tool to the housing, the tool may decouple from the housing before the wash ports are fully closed. As a result, a flow path may remain open between casings, which may be detrimental to mineral extraction operations. In addition, because an operator has no indication of the state of the wash ports, the operator may not know if corrective action should be performed.

Embodiments of the present disclosure may enable the housing running tool to rotate the housing in either a right-hand direction or a left-hand direction without uncoupling the tool from the housing. For example, in one embodiment, the housing running tool may include an inner sleeve having an exterior threaded surface configured to engage an interior threaded surface of the housing to rigidly couple the inner sleeve to the housing. The housing running tool may also include an outer sleeve disposed about the inner sleeve and including a key configured to selectively engage a slot of the housing such that rotation of the outer sleeve drives the housing to rotate when the key is engaged with the slot. The housing running tool may further include a retaining ring coupled to an interior surface of the outer sleeve. The retaining ring is configured to support the inner sleeve in an axial direction, and to enable the inner sleeve to rotate with respect to the outer sleeve. In this configuration, substantially all torque applied to the housing running tool in a circumferential direction is transferred to the housing via the outer sleeve. As a result, substantially no torque is applied to the inner sleeve, thereby ensuring that the inner sleeve remains coupled to the housing during rotation of the housing running tool.

FIG. 1 is a block diagram that illustrates an embodiment of a mineral extraction system 10. The illustrated mineral extraction system 10 can be configured to extract various minerals and natural resources, including hydrocarbons (e.g., oil and/or natural gas), or configured to inject substances into the earth. In the present embodiment, the mineral extraction system 10 is configured for subsea operations (e.g., for extraction of minerals beneath the sea floor). As illustrated, the mineral extraction system 10 includes a platform 12, such as a jackup rig or a platform drilled rig, at a surface 14 of the sea 16 (e.g., ocean, gulf, etc.). A conductor 18 extends from the platform 12 to a mineral deposit 20 located beneath the sea floor or mudline 22. A casing 24 extends through the conductor 18 to provide a flow path between the mineral deposit 20 and the surface 14. As discussed in detail below, the conductor 18 serves to support the casing 24 and various elements within the casing 24 such as tubing, hangers and/or other components configured for drilling and/or mineral extraction operations.

In the present configuration, the casing 24 is supported by a housing 26 at the surface 14 and a mudline hanger 28 at the sea floor 22. As will be appreciated, the housing 26 is configured to support the weight of the casing 24 between the surface 14 and the seafloor 22, while the mudline hanger 28 is configured to support the weight of the casing 24 between the sea floor 22 and the mineral deposit 20. In this configuration, the weight of the casing 24 is distributed over multiple points along the conductor 18, thereby decreasing stress within the conductor 18. In certain embodiments, the housing 26 is coupled to the conductor 18 at the surface 14 by a first landing ring assembly 30, and the mudline hanger 28 is coupled to the conductor 18 at the sea floor 22 by a second landing ring assembly 32.

As will be appreciated, during assembly of the mineral extraction system 10, the housing 26 and the mudline hanger 28 are run (e.g., lowered) into the conductor 18 toward the mineral deposit 20. During the running process, the housing 26 is coupled to a housing running tool 34, and the mudline hanger 28 is coupled to a mudline hanger running tool 36. Specifically, the mudline hanger running tool 36 serves to couple the mudline hanger 28 to the casing 24 above the mudline hanger 28, and the housing running tool 34 serves to couple the housing 26 to a drilling string 38. The drilling string 38 lowers the stack (e.g., casing 24, mudline hanger 28, mudline hanger running tool 36, housing 26 and housing running tool 34) into the conductor 18 until the mudline hanger landing ring assembly 32 engages a shoulder of the conductor 18. The housing landing ring assembly 30 is then coupled to the conductor 18.

After the mudline hanger 28 and the housing 26 have been landed, cement is injected between the casing 24 and an outer casing (not shown) within a region below the sea floor 22. The housing running tool 34 is then driven to rotate the housing 26, thereby rotating the casing 24 and the mudline hanger running tool 36. In the present configuration, the mudline hanger running tool 36 is coupled to the mudline hanger 28 by a threaded connection. Consequently, rotation of the mudline hanger running tool 36 causes the tool 36 to partially back out of the mudline hanger 28, thereby exposing wash ports. The wash ports establish a flow path between an interior of the casing 24 and an interior of the outer casing. Drilling fluid or "mud" is then pumped through the casing 24 and into the outer casing via the wash ports, thereby removing cement that may build up between the mudline hanger running tool 36 and the mudline hanger 28. Finally, the housing running tool 34 is rotated in the opposite direction to re-couple the mudline hanger running tool 36 to the mudline hanger 28.

In certain embodiments, the housing running tool is coupled to the housing 26 by a threaded connection. For example, the threaded connection may be configured to couple the tool to the housing 26 via left-hand rotation of the tool, and to decouple the tool from the housing 26 via right-hand rotation of the tool. Conversely, the threaded connection between the mudline hanger running tool 36 and the mudline hanger 28 may be configured to couple the tool 36 to the hanger 28 via right-hand rotation of the tool 36, and to decouple the tool 36 from the hanger 28 via left-hand rotation of the tool 36. In such a configuration, the housing running tool is rotated in a right-hand direction to re-couple the mudline hanger running tool 36 to the mudline hanger 28 after the cement removal process is complete, thereby closing the wash ports. However, if the torque required to close the wash ports is greater than the torque which couples the housing running tool to the housing 26, the tool may decouple from the housing 26 before the wash ports are fully closed. As a result, a flow path may remain open between the interior of the casing 24 and the outer casing, which may be detrimental to mineral extraction operations. In addition, because an operator has no indication of the state of the wash ports, the operator may not know if corrective action should be performed.

The present housing running tool 34 is configured to rotate the housing 26 in either a left-hand or right-hand direction without decoupling the housing running tool 34 from the housing 26. Specifically, the housing running tool 34 may include an inner sleeve having an exterior threaded surface configured to engage an interior threaded surface of the housing 26 to rigidly couple the inner sleeve to the housing 26. The housing running tool 34 may also include an outer sleeve disposed about the inner sleeve and including a key configured to selectively engage a slot of the housing 26 such that rotation of the outer sleeve drives the housing 26 to rotate when the key is engaged with the slot. The housing running tool 34 may further include a retaining ring coupled to an interior surface of the outer sleeve. The retaining ring is configured to support the inner sleeve in an axial direction, and to enable the inner sleeve to rotate with respect to the outer sleeve. In this configuration, substantially all torque applied to the housing running tool 34 in a circumferential direction is transferred to the housing 26 via the outer sleeve. As a result, substantially no torque is applied to the inner sleeve, thereby ensuring that the inner sleeve remains coupled to the housing 26 during rotation of the housing running tool 34.

Figure 2:
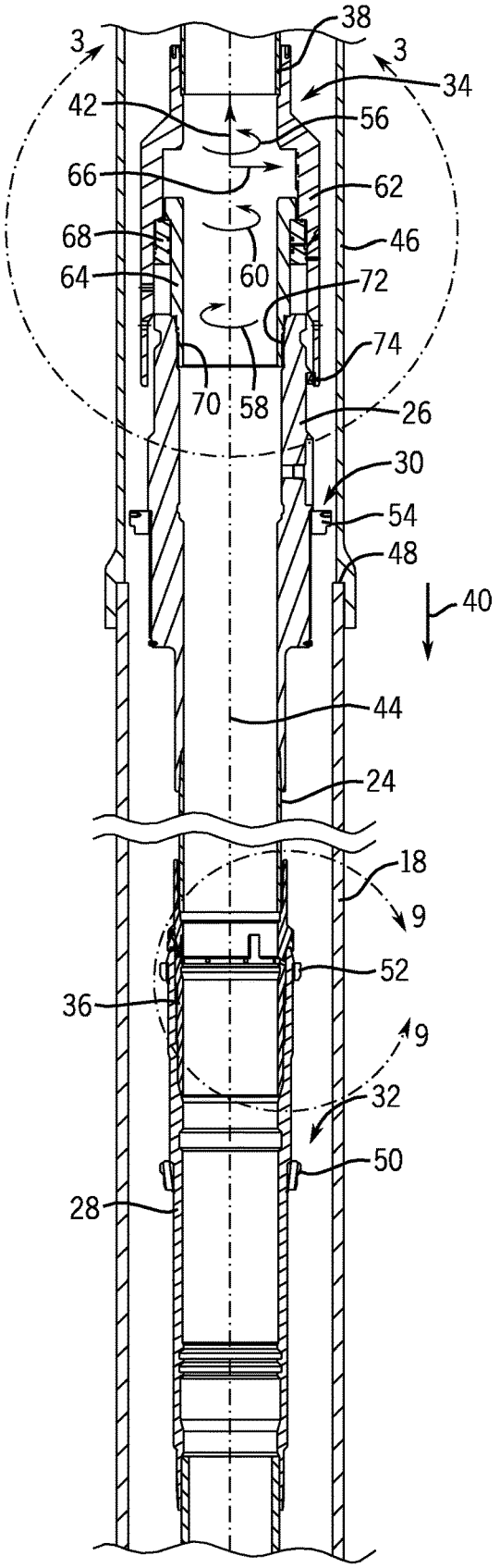
FIG. 2 is a cross-sectional view of a housing running tool having an outer sleeve configured to rotate a housing without disengaging the housing from the housing running tool in accordance with certain embodiments of the present technique.

FIG. 2 is a cross-sectional view of the housing running tool 34 having an outer sleeve configured to rotate a housing 26 without disengaging the housing 26 from the tool 34. As previously discussed, the stack (e.g., the housing running tool 34, the housing 26, the casing 24, the mudline hanger running tool 36 and the mudline hanger 28) is lowered into the conductor 18 via the drilling string 38. Specifically, the stack is run in a downward path 40 along an axial direction 42. In the present embodiment, the axial direction 42 corresponds to a longitudinal axis 44 of the stack. As illustrated, a diverter 46 is coupled to the conductor 18 to facilitate the running operation. In the present embodiment, the diverter 46 is engaged with a top surface 48 of the conductor 18, thereby securing the diverter 46 to the conductor 18.

As previously discussed, the stack is lowered into the conductor 18 until the mudline hanger landing ring assembly 32 engages a shoulder of the conductor 18. As illustrated the mudline hanger landing ring assembly 32 includes a landing ring 50 which engages the shoulder, thereby supporting the weight of the casing 24 below the mudline hanger 28. In addition, the mudline hanger landing ring assembly 32 includes a centralizer ring 52 which guides the mudline hanger 28 through the conductor 18 and ensures that the hanger 28 is substantially centered upon landing.

After the mudline hanger 28 is landed, the diverter 46 may be removed, thereby exposing the top surface 48 of the conductor 18. A solid landing ring may then be placed over the top surface 48 to support the weight of the housing 26 (and the casing 24 between the housing 26 and the mudline hanger 28). As will be appreciated, when the mudline hanger 28 is landed, the housing landing ring assembly 30 may not be properly aligned with the conductor 18 for landing the housing 26. Consequently, the present embodiment employs a threaded landing ring 54 which may translate in the axial direction 42 via rotation in a circumferential direction 56. Specifically, the threaded landing ring 54 includes threads along an inner surface configured to mate with corresponding threads of an outer surface of the housing 26. Therefore, rotation of the threaded landing ring 54 in a left-hand direction 58 or a right-hand direction 60 may drive the ring 54 along the axial direction 42. In this manner, the threaded landing ring 54 may be positioned to engage the solid landing ring positioned on the top surface 48 of the conductor 18. Consequently, both the mudline hanger 28 and the housing 26 may be properly landed within the well bore.

In the present embodiment, the housing running tool 34 is configured to rotate the housing 26 without disengaging the housing running tool 34. As a result, rotation of the housing running tool 34 may drive the wash ports to a closed position while maintaining the connection between the tool 34 and the housing 26. As illustrated, the housing running tool 34 includes an outer sleeve 62 and an inner sleeve 64 disposed radially inward (e.g., along a radial direction 66) from the outer sleeve 62. A retaining ring 68 blocks movement of the inner sleeve 64 relative to the outer sleeve 62 along the axial direction 42, while enabling the inner sleeve 64 to rotate with respect to the outer sleeve 62. The inner sleeve 64 includes an exterior threaded surface 70 (e.g., first mating surface) configured to mate with an interior threaded surface 72 (e.g., second mating surface) of the housing 26, thereby securing the housing running tool 34 to the housing 26. As a result of this configuration, the weight of the casing 24 may be transferred through the housing 26 to the inner sleeve 64 of the mudline hanger running tool 34. The weight may then be transferred to the outer sleeve 62 via the retaining ring 68. Therefore, the drilling string 38 may support the weight of the entire stack as the stack is lowered into the conductor 18.

The outer sleeve 62 includes a mounting feature, such as the key 74, configured to interface with a mounting feature (e.g., slot) within the housing 26. Contact between the key 74 and the slot rotationally couples the outer sleeve 62 to the housing 26 such that rotation of the housing running tool 34 drives the housing 26 to rotate. Because torque applied to the housing running tool 34 is transferred to the housing 26 via the key and slot interface, substantially no torque is applied to the threaded connection between the inner sleeve 64 and the housing 26. As a result, the housing 26 may be rotated via rotation of the outer sleeve 62 without disengaging the tool 34 from the housing 26. As illustrated, the outer sleeve 62 is coupled to the drilling string 38. Therefore, rotation of the drilling string 38 may drive the wash ports to an open or closed position while maintaining the connection between the housing running tool 34 and the housing 26.

Figure 3:
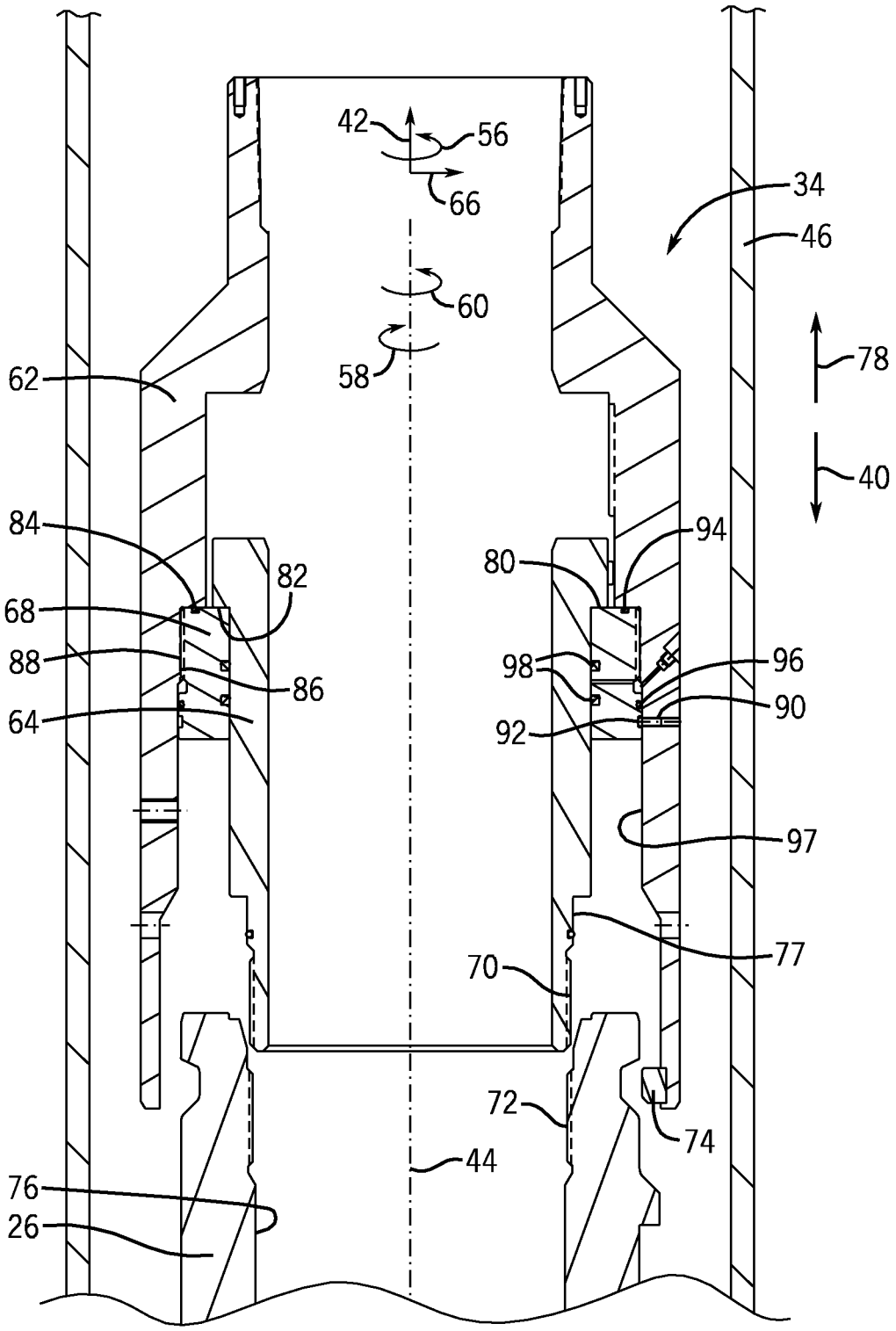
FIG. 3 is a cross-sectional view of the housing running tool, taken within line 3-3 of FIG. 2, prior to contact with the housing in accordance with certain embodiments of the present technique.

FIGS. 3 through 8 illustrate the process of coupling the housing running tool 34 to the housing 26. As will be appreciated, the steps described below may be performed in a reverse order to uncouple the tool 34 from the housing 26. FIG. 3 is a cross-sectional view of the housing running tool 34, taken within line 3-3 of FIG. 2, prior to contact with the housing 26. As previously discussed, an interior surface 76 of the housing 26 includes threads 72 configured to interface with threads 70 of an exterior surface 77 of the inner sleeve 64. Consequently, prior to coupling the housing running tool 34 to the housing 26, the exterior surface 77 of the inner sleeve 64 is aligned with the interior surface 76 of the housing 26.

As the housing running tool 34 is lowered toward the housing 26, the retaining ring 68 applies a force to the inner sleeve 64 in an upward direction 78, thereby blocking axial movement of the inner sleeve 64 in the downward direction 40. Specifically, a shoulder 80 of the inner sleeve 64 contacts a top surface 82 of the retaining ring 68 which blocks movement of the inner sleeve 64 in the direction 40. As illustrated, the retaining ring 68 is positioned adjacent to a shoulder 84 of the outer sleeve 62, and is rigidly coupled to the outer sleeve 62. In the present embodiment, the retaining ring 68 includes a threading surface 86 configured to interface with a threading surface 88 of the outer sleeve 62, thereby securing the ring 68 to the outer sleeve 62. While the present embodiment utilizes a Stub Acme threaded connection, it should be appreciated that other threaded connections may be employed in alternative embodiments.

To ensure that the retaining ring 68 does not become uncoupled from the outer sleeve 62, a pin may be inserted into the ring 68 through the outer sleeve 62. Consequently, the outer sleeve 62 includes an opening 90 configured to facilitate passage of a pin through the outer sleeve 62, and the retaining ring 68 includes a recess 92 configured to receive the pin. In addition, the retaining ring 68 includes multiple seals configured to block fluid flow between the inner and outer sleeves 62 and 64. Specifically, the retaining ring 68 includes a first seal 94 positioned between the top surface 82 of the retaining ring 68 and the shoulder 84 of the outer sleeve 62. The retaining ring 68 also includes a second seal 96 positioned between the retaining ring 68 and an interior surface 97 of the outer sleeve 62. In addition, the retaining ring 68 includes a pair of seals 98 positioned between the retaining ring 68 and the exterior surface 77 of the inner sleeve 64. As will be appreciated, each of the seals 94, 96 and 98 may be a rubber o-ring, or any other suitable device configured to block fluid flow between the inner sleeve 64 and the outer sleeve 62 despite movement of the inner sleeve 64 relative to the outer sleeve 62 along the axial direction 42.

Figure 4:
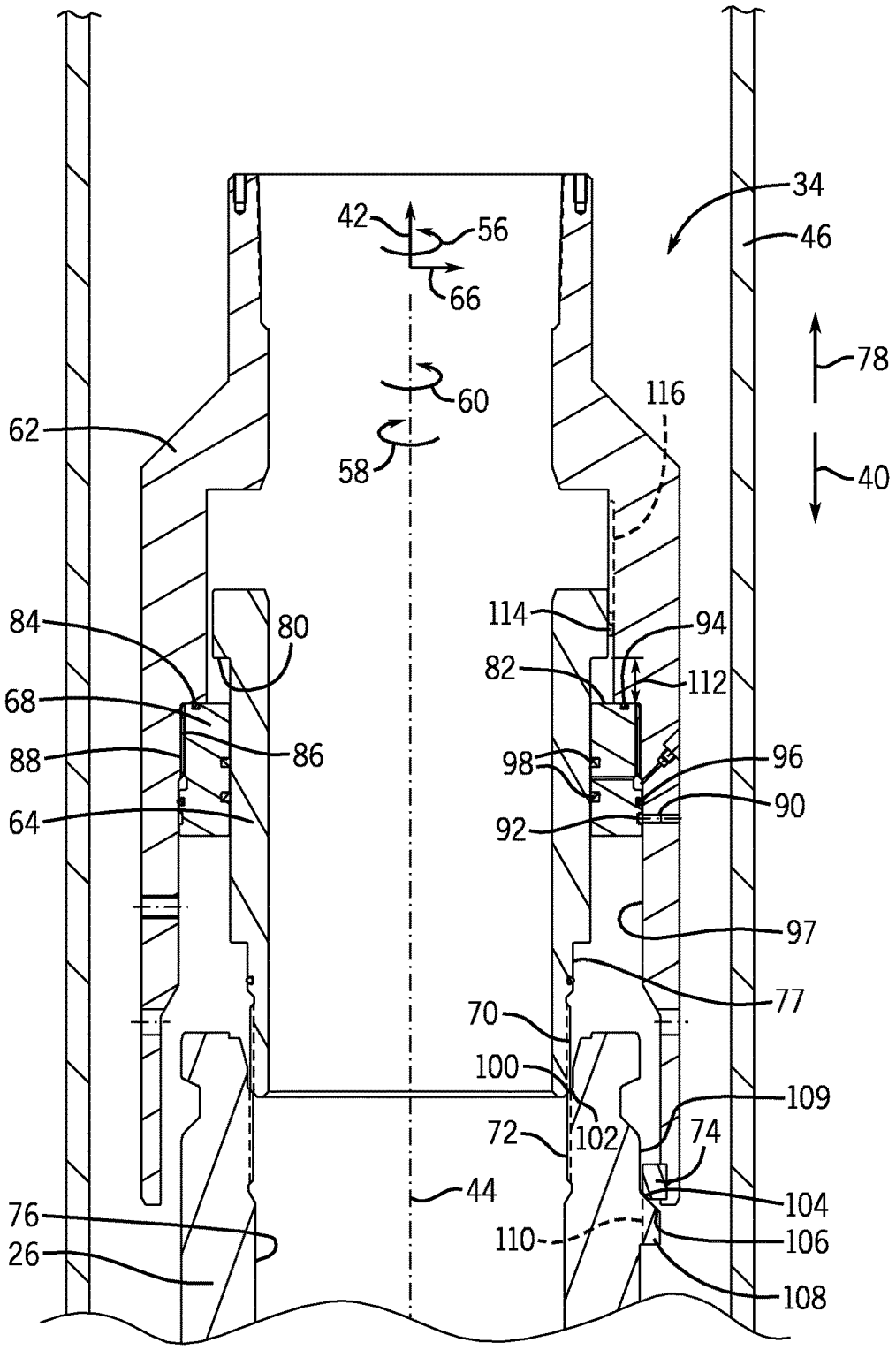
FIG. 4 is a cross-sectional view of the housing running tool, taken within line 3-3 of FIG. 2, in which a tapered portion of an inner sleeve of the housing running tool is in contact with a shoulder of the housing, and a key coupled to the inner sleeve is engaged with a slot of the outer sleeve in accordance with certain embodiments of the present technique.

FIG. 4 is a cross-sectional view of the housing running tool 34, taken within line 3-3 of FIG. 2, in which a tapered portion of the inner sleeve 64 of the housing running tool 34 is in contact with a shoulder of the housing 26, and a key coupled to the inner sleeve 54 is engaged with a slot of the outer sleeve 62. As illustrated, the housing running tool 34 is in a lower position along the direction 40 from the position illustrated in FIG. 3. In the present position, a tapered portion 100 of the inner sleeve 64 is in contact with a shoulder 102 of the housing 26. Due to the threading surfaces 70 and 72, further movement of the inner sleeve 64 in the downward direction 40 is blocked by contact between the surfaces 100 and 102. However, as discussed in detail below, rotation of the inner sleeve 64 in the circumferential direction 56 will induce the threading surface 70 of the inner sleeve 64 to engage the threading surface 72 of the housing 26, thereby coupling the inner sleeve 64 to the housing 26.

As illustrated, the outer sleeve 62 may be translated in the downward direction 40 even after downward movement of the inner sleeve 64 is blocked by contact with the housing 26. In the present configuration, the outer sleeve 64 may be translated in the downward direction 40 until downward movement is blocked by contact between a tapered portion 104 of the key 74 and a tapered portion 106 of a protrusion 108 disposed on an exterior surface 109 of the housing 26. As discussed in detail below, the protrusion 108 includes a slot 110 configured to interface with the key 74 such that rotation of the outer sleeve 62 drives the housing 26 to rotate. However, when initially lowering the housing running tool 34, the key 74 may not align with the slot 110. Therefore, downward movement of the outer sleeve 62 may be blocked until the outer sleeve 62 is rotated to align the key 74 with the slot 110. While one key 74 and one slot 110 are illustrated in the present embodiment, it should be appreciated that alternative embodiments may include more keys 74 and more slots 110. For example, certain configurations may employ 2, 3, 4, 5, 6, 7, 8, or more keys 74, and an equal number of slots 110. As will be appreciated, in such configurations, the circumferential spacing of the keys 74 will substantially correspond to the circumferential spacing of the slots 110 such that rotation of the outer sleeve 62 may align each key 74 with each slot 110.

As illustrated, when the key 74 contacts the protrusion 108, the inner sleeve 64 is displaced a distance 112 along the axial direction 42 from the position illustrated in FIG. 3 (e.g., contact between the top surface 82 of the retaining ring 68 and the shoulder 80 of the inner sleeve 64). In the present configuration, the inner sleeve 64 includes a mounting feature, such as the key 114, configured to interface with a corresponding mounting feature, such as the slot 116, within the interior surface 97 of the outer sleeve 62. Once the key 114 is disposed within the slot 116, contact between the key 114 and the slot 116 blocks rotation of the inner sleeve 64 with respect to the outer sleeve 62. Consequently, rotation of the outer sleeve 62 will drive the inner sleeve 64 to rotate. While one key 114 and one slot 116 are employed in the present embodiment, it should be appreciated that alternative embodiments may include more keys 114 and more slots 116. For example, certain embodiments may employ 2, 3, 4, 5, 6, 7, 8, or more keys 114, and an equal number of slots 110. As will be appreciated, the keys 114 and slots 116 may be spaced about the inner and outer sleeves 64 and 62 along the circumferential direction 56. It should also be appreciated that in such multiple key and slot configurations, the keys 114 and slots 116 will be circumferentially aligned such that each key 114 engages a corresponding slot 116.

Figure 5:
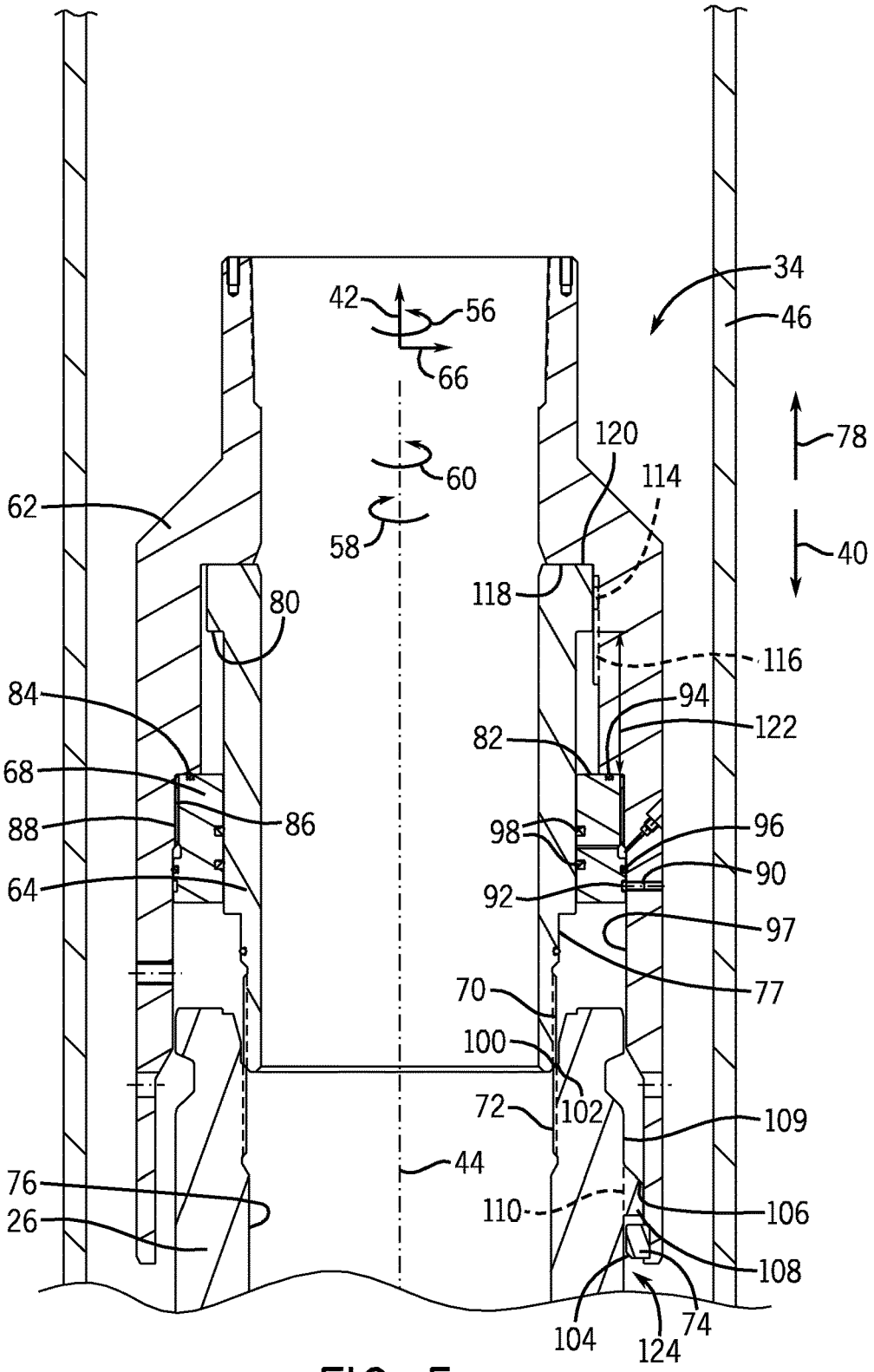
FIG. 5 is a cross-sectional view of the housing running tool, taken within line 3-3 of FIG. 2, in which a key coupled to the outer sleeve of the housing running tool has passed through a slot within a protrusion of the housing in accordance with certain embodiments of the present technique.

FIG. 5 is a cross-sectional view of the housing running tool 34, taken within line 3-3 of FIG. 2, in which the key 74 coupled to the outer sleeve 62 of the housing running tool 34 has passed through the slot 110 within the protrusion 108 of the housing 26. As previously discussed, the outer sleeve 62 may be rotated such that the key 74 aligns with the slot 110 without rotating the inner sleeve 62. Once the key 74 is aligned with the slot 110, the outer sleeve 62 may be translated in the downward direction 40 such that the key 74 pass through the slot 110. As illustrated, further downward movement of the outer sleeve 62 is blocked by contact between a top surface 118 of the inner sleeve 64 and a shoulder 120 of the outer sleeve 62.

In the illustrated position, the inner sleeve 64 is displaced a distance 122 along the axial direction 42 from the position illustrated in FIG. 3 (e.g., contact between the top surface 82 of the retaining ring 68 and the shoulder 80 of the inner sleeve 64). As a result, the key 114 is engaged with the slot 116 such that rotation of the inner sleeve 64 relative to the outer sleeve 62 is blocked by contact between the key 114 and the slot 116. Consequently, in the present state, rotation of the outer sleeve 62 will drive the inner sleeve 64 to rotate. However, because the key 74 is not disposed within the slot 110, rotation of the outer sleeve 62 will not drive the housing 26 to rotate. Specifically, the key 74 is positioned within a recess 124 located axially downward (e.g., in the direction 40) from the protrusion 108. Because the outer sleeve 62 is rotationally coupled to the inner sleeve 64 and not rotationally coupled to the housing 26, rotation of the outer sleeve 62 will induce the inner sleeve 64 to rotate relative to the housing 26. Therefore, as the outer sleeve 62 rotates, the threads 70 of the inner sleeve 64 will engage the threads 72 of the housing 26, thereby coupling the inner sleeve 64 to the housing 26.

Figure 6:
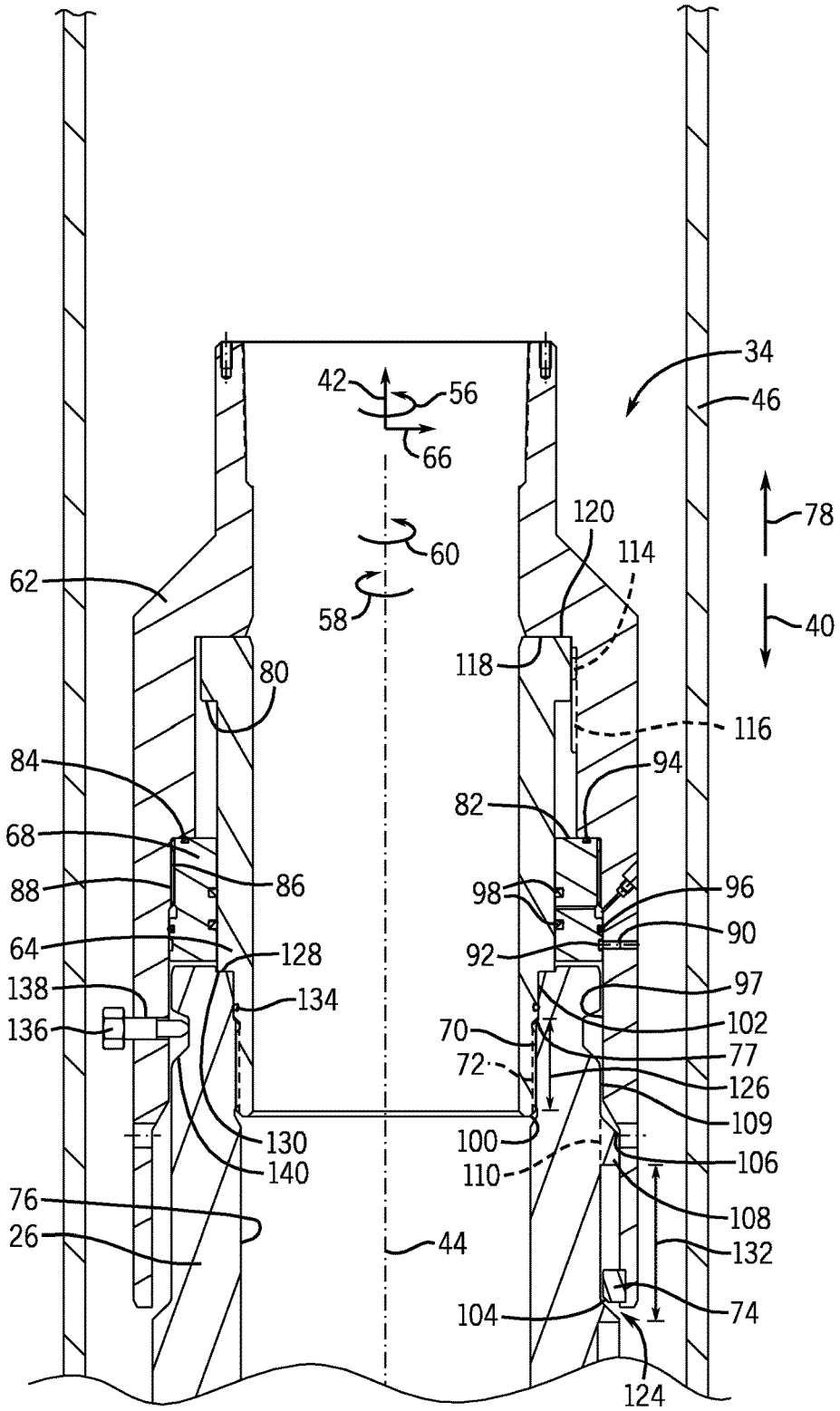
FIG. 6 is a cross-sectional view of the housing running tool, taken within line 3-3 of FIG. 2, in which the inner sleeve is fully engaged with the housing in accordance with certain embodiments of the present technique.

FIG. 6 is a cross-sectional view of the housing running tool 34, taken within line 3-3 of FIG. 2, in which the inner sleeve 64 is fully engaged within the housing 26. As previously discussed, because the outer sleeve 62 is rotationally coupled to the inner sleeve 64 and not rotationally coupled to the housing 26, rotation of the outer sleeve 62 will induce the threads 70 of the inner sleeve 64 to engage the threads 72 of the housing 26. As a result, the inner sleeve 64 may be driven in the downward direction 40 a distance 126 such that the threads 70 are fully engaged with the threads 72, thereby coupling the inner sleeve 64 to the housing 26. As illustrated, further downward movement in the direction 40 will be blocked by contact between a shoulder 128 of the inner sleeve 64 and a recess 130 within the housing 26. As the inner sleeve 64 is driven in the downward direction 40, the outer sleeve 62 will also move downward by substantially the same distance. Consequently, a length 132 of the recess 124 is configured to facilitate movement of the key 74 within the recess 124 without contacting the exterior surface 109 of the housing 26. In addition, a seal (e.g., rubber o-ring, etc.) 134 may be disposed between the exterior surface 77 of the inner sleeve 64 and the interior surface 76 of the housing 26 to block fluid flow between the housing 26 and the housing running tool 34.

While movement of the outer sleeve 62 in the downward direction 40 is blocked by contact between a top surface 118 of the inner sleeve 64 and a shoulder 120 of the outer sleeve 62, the outer sleeve 62 is free to translate in the upward direction 78. Consequently, a pin 136 may be disposed through an opening 138 within the outer sleeve 62 and into a recess 140 within the housing 26. As a result of this configuration, movement of the outer sleeve 62 in the upward axial direction 78 will be blocked by contact between the pin 136 and the recess 140. As will be appreciated, the steps described above with reference to FIGS. 3 through 6 may be performed prior to coupling the housing 26 to the casing 24 and/or prior to coupling the drilling string 38 to the housing running tool 34. In certain situations, these steps may be performed prior to delivering the housing 26 and the housing running tool 34 to the platform 12. In such situations, limiting axial movement of the outer sleeve 62 may ensure the integrity of the above-described components within the tool 34 and/or the housing 26.

Figure 7:
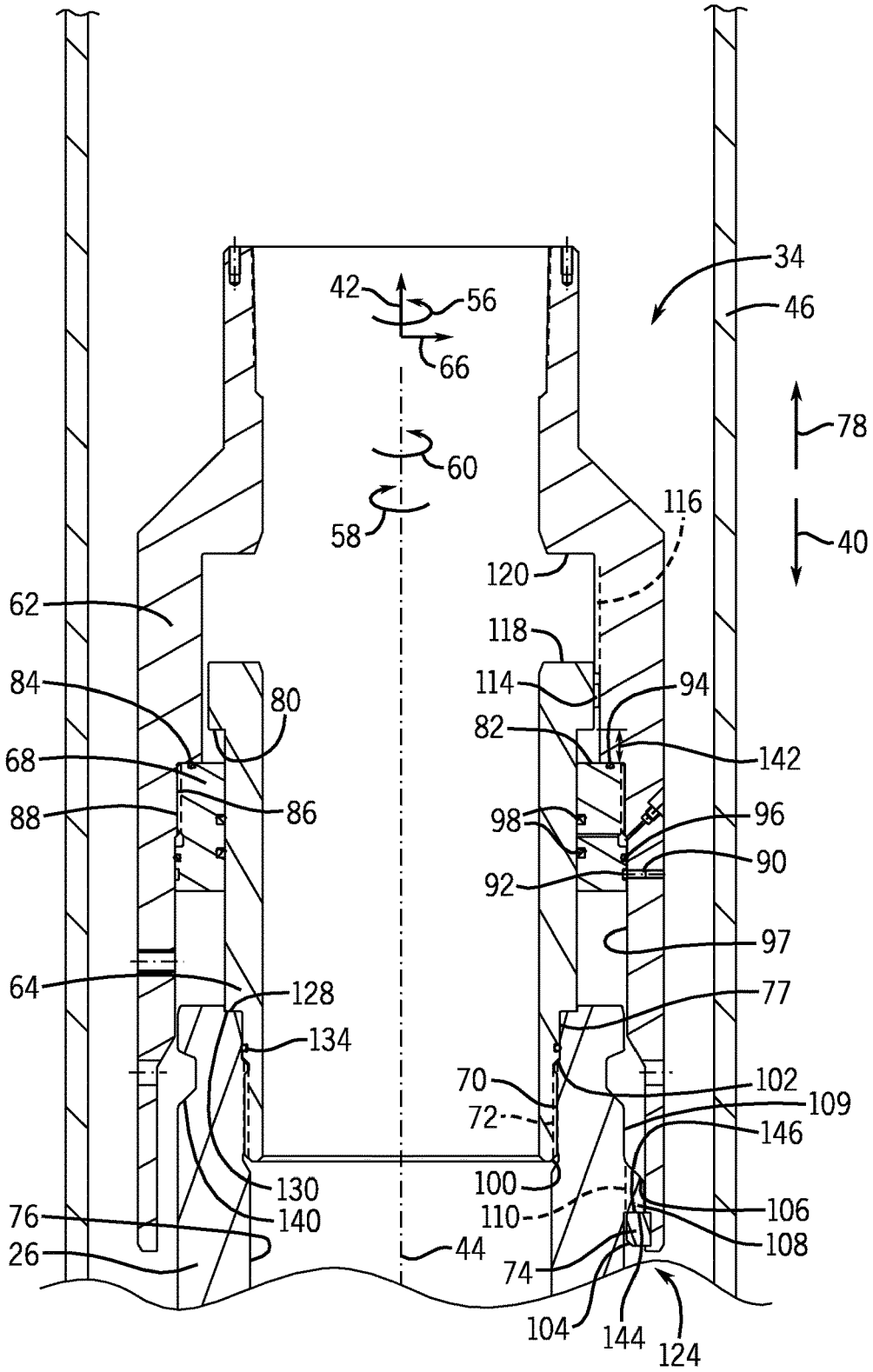
FIG. 7 is a cross-sectional view of the housing running tool, taken within line 3-3 of FIG. 2, in which a top surface of the key is in contact with a bottom surface of the protrusion of the housing in accordance with certain embodiments of the present technique.

FIG. 7 is a cross-sectional view of the housing running tool 34, taken within line 3-3 of FIG. 2, in which a top surface of the key 74 is in contact with a bottom surface of the protrusion 108 of the housing 26. Prior to running the housing 26 and the housing running tool 34, the pin 136 may be removed. Consequently, the outer sleeve 62 may freely translate in the upward axial direction 78. As illustrated, the outer sleeve 62 is translated in the upward axial direction 78 such that the inner sleeve 64 is displaced a distance 142 along the axial direction 42 from the position illustrated in FIG. 3 (e.g., contact between the top surface 82 of the retaining ring 68 and the shoulder 80 of the inner sleeve 64). Specifically, the outer casing 62 is translated in the upward direction 78 until movement is blocked by contact between an upper surface 144 of the key 74 and a lower surface 146 of the protrusion 108. As previously discussed, unless the key 74 is aligned with the slot 110, the key 74 may not pass through the protrusion 108. In the present configuration, the key 74 is not configured to support the weight of the housing 26 and casing 24 in the axial direction 42. Consequently, the housing running tool 34 may not support the axial load via contact between the upper surface 144 of the key 74 and the lower surface 146 of the slot 110.

As illustrated, while the inner sleeve 64 is positioned a distance 142 from the retaining ring 68, the key 114 is not disposed within the slot 116. Therefore, the outer sleeve 62 may rotate independently from the inner sleeve 64. As a result, the outer sleeve 62 may be rotated such that the key 74 is aligned with the slot 110 without uncoupling the inner sleeve 64 from the housing 26. As discussed in detail below, once the key 74 is aligned with the slot 110, the outer sleeve 62 may be translated in the axially upward direction 78 until the key 74 is disposed within the slot 110.

Figure 8:
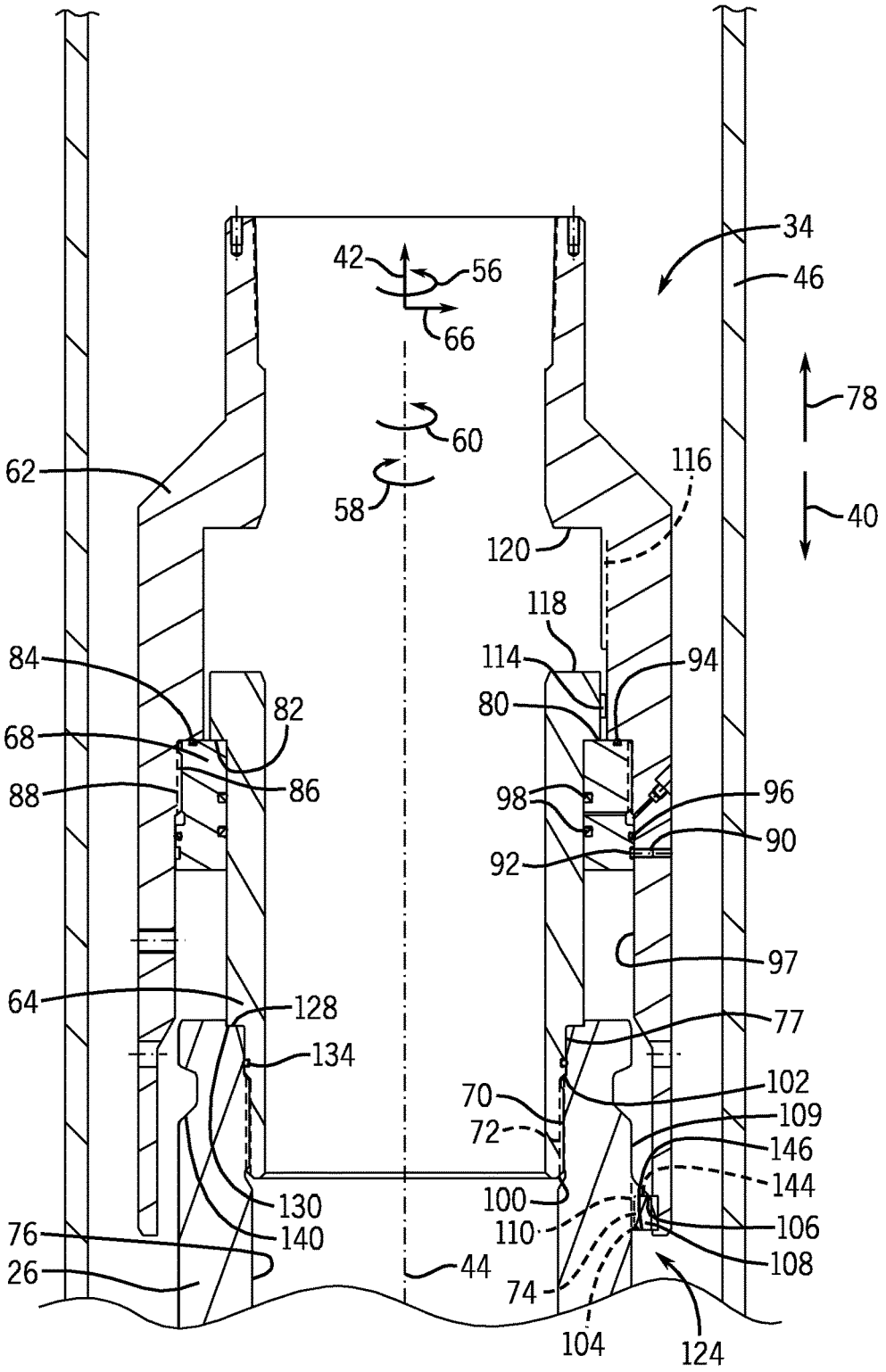
FIG. 8 is a cross-sectional view of the housing running tool, taken within line 3-3 of FIG. 2, in which the key is disposed within the slot of the protrusion and the outer sleeve may rotate the housing independently of the inner sleeve in accordance with certain embodiments of the present technique.

FIG. 8 is a cross-sectional view of the housing running tool 34, taken within line 3-3 of FIG. 2, in which the key 74 is disposed within the slot 110 of the protrusion 108, and the outer sleeve 62 may rotate the housing 26 independently of the inner sleeve 64. As previously discussed, the outer sleeve 62 is rotated in the circumferential direction 56 such that the key 74 is aligned with the slot 110. Next, the outer sleeve 62 is translated in the axially upward direction 78 from the position illustrated in FIG. 7 such that the key 74 engages the slot 110. As previously discussed, contact between the key 74 and the slot 110 rotationally couples the outer sleeve 62 of the housing running tool 34 to the housing 26 such that rotation of the outer sleeve 62 drives the housing 26 to rotate. Furthermore, because the key 114 is not disposed within the slot 116, the outer sleeve 62 may rotate independently of the inner sleeve 64. Consequently, torque applied to the outer sleeve 62 in the direction 58 or 60 is transferred to the housing 26 via the key and slot interface. Because the inner sleeve 64 is not rotationally coupled to the outer sleeve 62, substantially no torque is transferred to the inner sleeve 64. As a result, rotation of the housing running tool 34 will drive the housing 26 to rotate while maintaining the connection between the tool 34 and the housing 26. In this configuration, the axial load of the housing 26 and casing 24 may be supported by the housing running tool 34 via the threaded connection between the inner sleeve 64 and the housing 26.

As previously discussed, rotating the housing 26 drives the casing 24 to rotate, thereby driving the mudline hanger running tool 36 to selectively engage or disengage the mudline hanger 28. Because the housing running tool 34 transfers torque to the housing 26 through the outer sleeve 62, a sufficient torque may be applied to the mudline hanger running tool 36 to close the wash ports without uncoupling the housing running tool 34 from the housing 26. Furthermore, the wash ports may be repeatedly opened and closed via rotation of the housing running tool 34 while maintaining the connection between the tool 34 and the housing 26.

To uncoupled the housing running tool 34 from the housing 26, the steps described above may be performed in a reverse order. For example, the outer sleeve 62 may be lowered in the axially downward direction 40 until the key 114 engages the slot 116, thereby rotationally coupling the outer sleeve 62 with the inner sleeve 64. As will be appreciated, with the outer sleeve 62 in the lowered position, the key 74 will disengage the slot 110, thereby uncoupling the outer sleeve 62 from the housing 26. The outer sleeve 62 may then be rotated in the circumferential direction 56 to uncouple the inner sleeve 64 from the housing 26. As will be appreciated, such an operation will place the housing running tool 34 in the condition shown in FIG. 5. In such a state, movement of the outer sleeve 62 in the axially upward direction 78 may be blocked by contact between the top surface 144 of the key 74 and the bottom surface 146 of the protrusion 108. Therefore, the outer sleeve 62 may be rotated until the key 74 is aligned with the slot 110. At this point, the housing running tool 34 may be removed from the housing 26 by translation in the axially upward direction 78.

Figure 9:
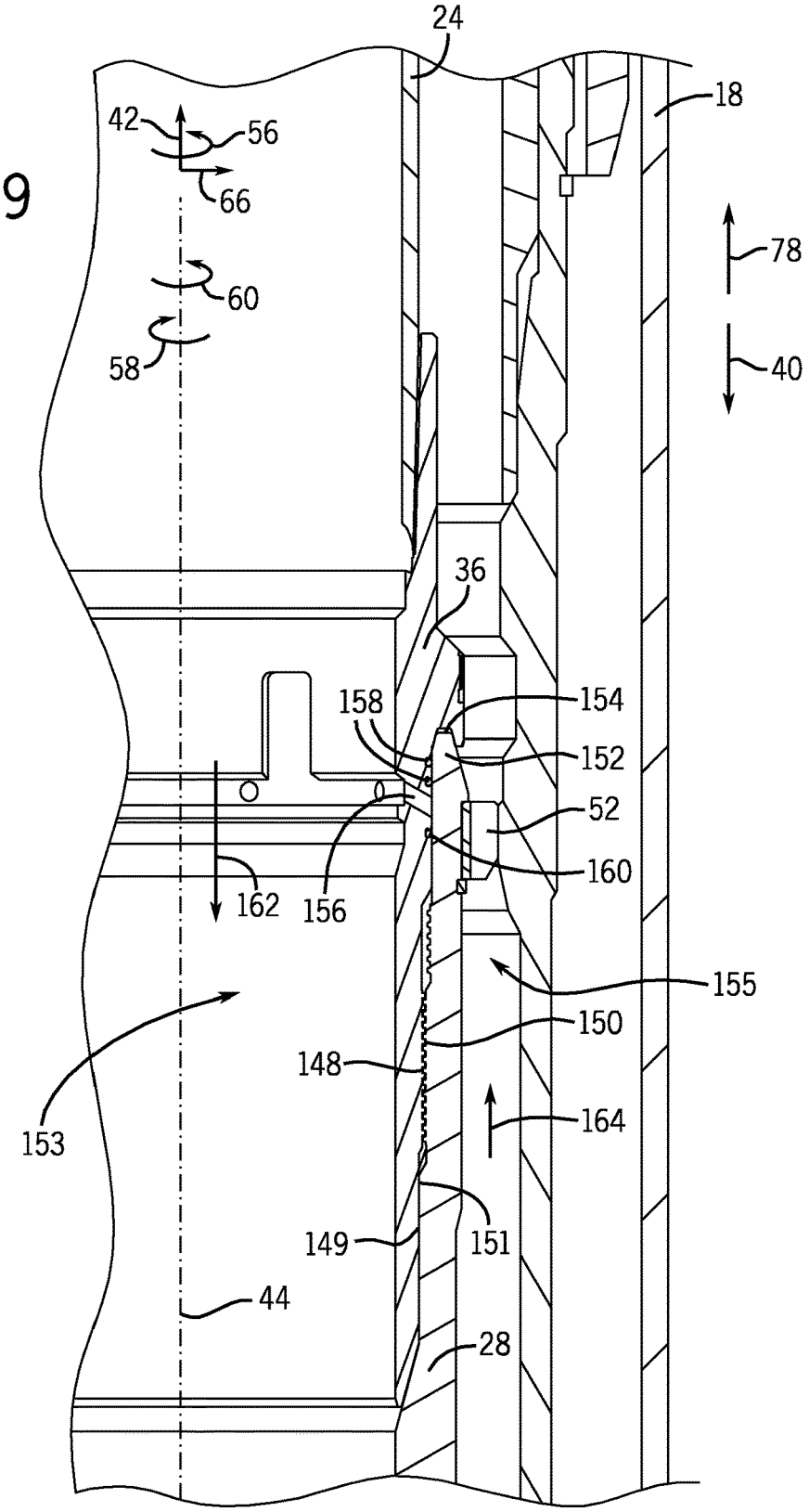
FIG. 9 is a cross-sectional view of the mudline hanger running tool, taken within line 9-9 of FIG. 2, in which the wash port is in a closed position in accordance with certain embodiments of the present technique.

FIG. 9 is a cross-sectional view of the mudline hanger running tool 36, taken within line 9-9 of FIG. 2, in which the wash port is in a closed position. As previously discussed, the mudline hanger running tool 36 is coupled to the mudline hanger 28 to support the mudline hanger 28 during the running process. Specifically, the mudline hanger running tool 36 includes mating threads 148 on an exterior surface 149 of the tool 36, and the mudline hanger 28 includes mating threads 150 on an interior surface 151 of the hanger 28. In the present configuration, the threads 148 and 150 are configured to engage via rotation of the mudline hanger running tool 36 in the right-hand direction 60, and to disengage via rotation of the mudline hanger running tool 36 in the left-hand direction 58. As will be appreciated, prior to rotating the mudline hanger running tool 36, the weight of the mudline hanger running tool 36, the casing 24 and the housing 26 may be transferred to the housing running tool 34 by pulling the housing running tool 34 in the axially upward direction 78. In this manner, an axial load between the threads 148 and 150 will be reduced, thereby facilitating rotation of the mudline hanger running tool 36 relative to the mudline hanger 28.

In the illustrated engaged position, a tang 152 of the mudline hanger 28 is disposed within a recess 154 of the mudline hanger running tool 36. The tang and recess interface is configured to block fluid flow between an interior 153 of the casing 24 and an interior 155 of a surrounding casing. As illustrated, a wash port 156 is disposed within the mudline hanger running tool 36, and serves to provide a flow path between the interior 153 of the casing 24 and the interior 155 of the surrounding casing when in an open position. As will be appreciated, multiple wash ports 156 may be disposed about the mudline hanger running tool 36 in the circumferential direction 56. In the present configuration, a pair of seals (e.g., rubber o-rings, etc.) 158 above the wash port 156 serve to block fluid flow between the interior 155 of the surrounding casing and the interior 153 of the casing 24 while the wash port 156 is in the closed position. Similarly, a seal (e.g., rubber o-ring, etc.) 160 below the wash port 156 serves to block fluid flow between the interior 153 of the casing 24 and the interior 155 of the surrounding casing while the wash port 156 is in the open position. As discussed in detail below, the wash port 156 may be opened by rotating the mudline hanger running tool 36 in the left-hand direction 58, thereby driving the tool 36 in the axially upward direction 78 and exposing the port 156.

With the wash port 156 in the illustrated closed position, a cementing operation may be performed to seal the volume between casings. For example, cement may be pumped through the interior 153 of the casing 24 in the direction 162. Once the cement reaches the bottom of the casing 24 the cement will flow into the interior 155 of the surrounding casing in the direction 164. In certain situations, cement may be pumped into the casing 24 until the level of cement within the interior 155 of the surrounding casing reaches the top of the mudline hanger 28. However, during the cementing process, cement may flow between the tang 152 of the mudline hanger 28 and the recess 154 of the mudline hanger running tool 36. If the cement hardens, it may become difficult to separate the mudline hanger running tool 36 from the mudline hanger 28. Therefore, as discussed in detail below, the wash port 156 may be opened and drilling fluid may be pumped through the wash port 156 to remove cement from the tang 152 and the recess 154.

Figure 10:
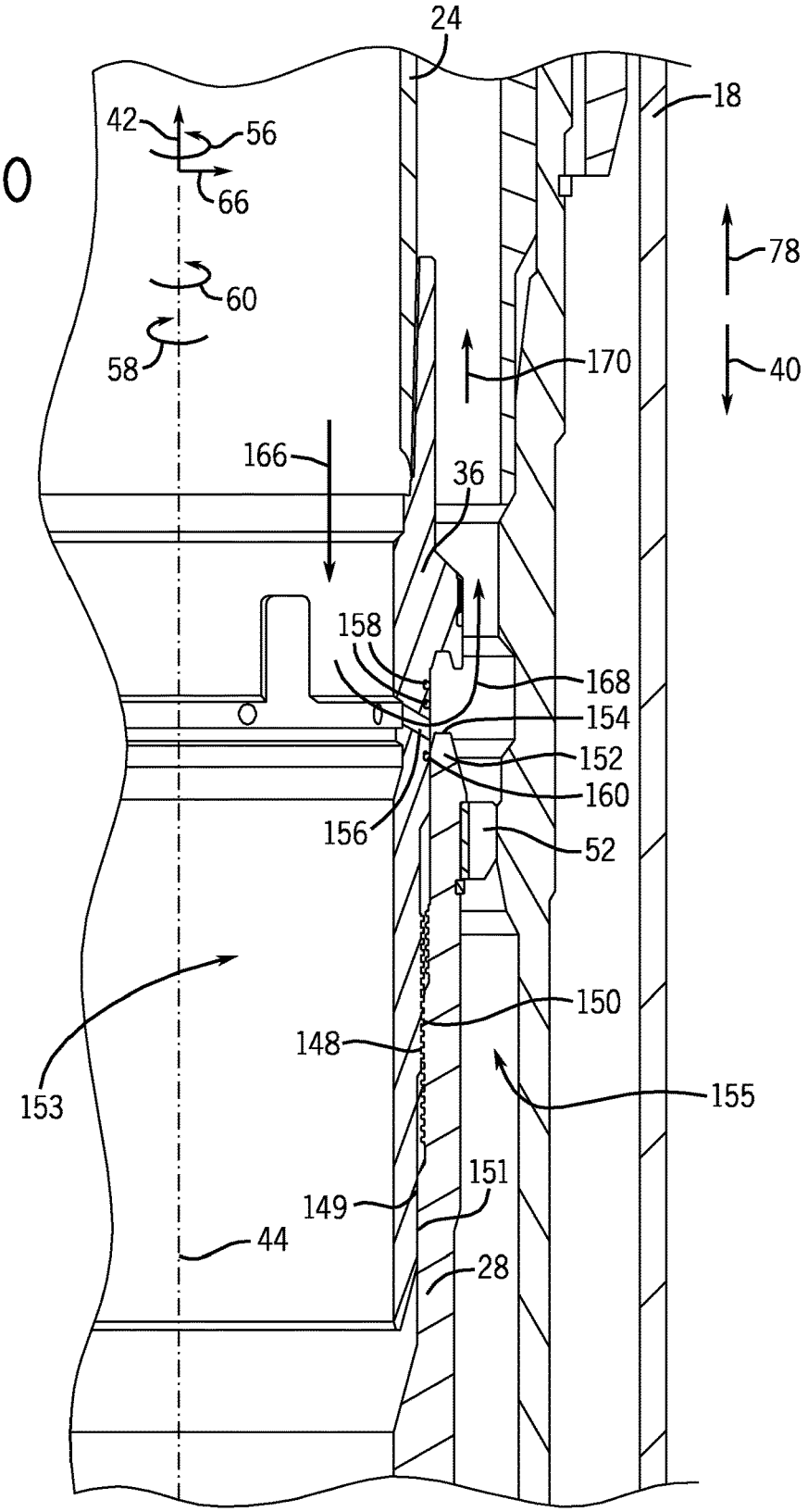
FIG. 10 is a cross-sectional view of the mudline hanger running tool, taken within line 9-9 of FIG. 2, in which the wash port is in an open position in accordance with certain embodiments of the present technique.

FIG. 10 is a cross-sectional view of the mudline hanger running tool 36, taken within line 9-9 of FIG. 2, in which the wash port 156 is in an open position. As previously discussed, the wash port 156 may be opened by rotating the mudline hanger running tool 36 in the left-hand direction 58, thereby driving the tool 36 in the axially upward direction 78 and exposing the wash port 156. Because the mudline hanger running tool 36 may be driven to rotate by rotation of the outer sleeve 62 of the housing running tool 34 (via the key and slot interface with the housing 26), the wash port 156 may be opened without applying a torque to the inner sleeve 64/housing 26 interface, thereby ensuring that the housing 26 remains coupled to the housing running tool 34 during the wash port opening process.

After the wash port 156 has been opened, drilling fluid may be pumped in the direction 166 through the interior 153 of the casing 24. The drilling fluid will then flow in the direction 168 through the wash port 156, and into the interior 155 of the surrounding casing in the direction 170. As illustrated, the drilling fluid flows between the tang 152 and the recess 154, thereby removing cement that may interfere with operation of the mudline hanger running tool 36. After the washing process is complete, the wash port 156 may be closed by rotating the mudline hanger running tool 36 in the right-hand direction 60. Because the mudline hanger running tool 36 may be driven to rotate by rotation of the outer sleeve 62 of the housing running tool 34 (via the key and slot interface with the housing 26), the wash port 156 may be closed without applying a torque to the inner sleeve 64/housing 26 interface, thereby ensuring that the housing 26 remains coupled to the housing running tool 34 during the wash port closing process. While the present mudline hanger running tool 36 and mudline hanger 28 are configured to engage via right-hand rotation of the tool 36 and to disengage via left-hand rotation of the tool 36, it should be appreciated that alternative embodiments may employ a tool 36 and hanger 28 configured to engage and disengage via opposite directions of rotation.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a first tool configured to run a hanger into a bore of a mineral extraction system, wherein the first tool comprises:

a first tool body having one or more fluid ports; and a hanger coupling configured to couple with a mating hanger coupling of the hanger, wherein the first tool is configured to move between a first position and a second position, the one or more fluid ports are closed in the first position, and the one or more fluid ports are open in the second position; and a housing axially offset from and coupled to the first tool, wherein the housing is configured to be run into the bore of the mineral extraction system, and the housing comprises:

a rotational coupling configured to couple the housing with a second tool; and a torque transfer coupling configured to couple the housing with the second tool via a first key and slot interface, wherein the housing is configured to move the first tool between the first and second positions in response to a torque transfer from the second tool to the first tool via the torque transfer coupling.

2. The system of claim 1, wherein the one or more fluid ports comprise one or more wash ports extending between an interior space and an exterior space relative to the first tool body.

3. The system of claim 1, wherein the housing comprises a landing structure disposed about an outer circumference of the housing, and the landing structure is configured to land on a mating landing structure in the bore.

4. The system of claim 1, wherein the rotational coupling comprises threads configured to couple with mating threads of the second tool.

5. The system of claim 1, wherein the first tool is configured to rotate between the first position and the second position.

6. The system of claim 5, wherein the hanger coupling comprises threads configured to couple to mating threads of the mating hanger coupling of the hanger.

7. The system of claim 6, comprising the hanger, wherein the one or more fluid ports are closed in the first position by the hanger covering the one or more fluid ports, and the one or more fluid ports are open in the second position by the hanger uncovering the one or more fluid ports.

8. The system of claim 7, wherein the first tool body comprises a recess on a first side of the one or more fluid ports, the recess is configured to receive a tang of the hanger in the first position of the first tool, and the tang is disposed on an opposite second side of the one or more fluid ports in the second position of the first tool.

9. The system of claim 1, wherein the rotational coupling is disposed along a first circumferential interface between the second tool and the housing, and the torque transfer coupling is disposed along a second circumferential interface between the second tool and the housing.

10. The system of claim 9, wherein the second circumferential interface having the torque transfer coupling is disposed about the first circumferential interface having the rotational coupling.

11. The system of claim 1, wherein the second tool is configured to selectively disengage the first key and slot interface to enable rotation between the second tool and the housing, and selectively engage the first key and slot interface to enable the torque transfer.

12. The system of claim 11, wherein the first key and slot interface is disengaged in a first axial position of the second tool relative to the housing, and the first key and slot interface is engaged in a second axial position of the second tool relative to the housing.

13. The system of claim 1, wherein the second tool comprises first and second portions and a second key and slot interface, the first portion is configured to couple to the housing via the rotational coupling, the second portion is configured to couple to the housing via the torque transfer coupling, the second tool is configured to selectively disengage the second key and slot interface to enable rotation between the first and second portions, and selectively engage the second key and slot interface to block rotation between the first and second portions.

14. The system of claim 1, wherein the second tool is configured to move the housing via the torque transfer coupling to cause movement of the first tool between the first position and the second position while maintaining a connection of the rotational coupling between the second tool and the housing.

15. The system of claim 14, wherein the second tool is configured to rotate the first tool between the first position and the second position.

16. The system of claim 1, wherein the second tool comprises a coaxial arrangement of a first sleeve and a second sleeve, wherein the first sleeve is selectively coupled to an interior portion of the housing, and the second sleeve is selectively coupled to an exterior portion of the housing.

17. The system of claim 16, wherein the first and second sleeves are rotationally coupled together in a first relative axial position, and the first and second sleeves are rotationally uncoupled from one another in a second relative axial position.

18. The system of claim 17, wherein the second tool is configured to maintain a connection of the rotational coupling between the second tool and the housing when rotating the second tool in both a right-hand direction and a left-hand direction when in the first relative axial position.

19. The system of claim 17, wherein the second tool has a second key and slot interface engaged in the first relative axial position between the first and second sleeves, and the second tool has the second key and slot interface disengaged in the second relative axial position between the first and second sleeves.

20. A system, comprising:

a first tool configured to run a hanger into a bore of a mineral extraction system, wherein the first tool comprises:

a first tool body having one or more fluid ports; and a hanger coupling configured to couple with a mating hanger coupling of the hanger, wherein the first tool is configured to move between a first position and a second position, the one or more fluid ports are closed in the first position, and the one or more fluid ports are open in the second position; and a second tool coupled to the first tool at an axial offset distance, wherein the second tool is configured to run a housing into the bore of the mineral extraction system, and the second tool comprises:

a rotational coupling configured to couple the second tool with the housing; and a torque transfer coupling configured to couple the second tool with the housing via a first key and slot interface, wherein the torque transfer coupling is configured to transfer torque from the second tool to the housing to move the first tool between the first and second positions.

21. The system of claim 20, wherein the second tool is configured to move the first tool between the first position and the second position while maintaining a connection of the rotational coupling between the second tool and the housing.

22. A method, comprising:

coupling a hanger to a first tool having one or more fluid ports in a first tool body;

coupling a second tool to a housing with a rotational coupling and a torque transfer coupling having a first key and slot interface between the second tool and the housing;

simultaneously running the first tool with the hanger and the second tool with the housing into a bore of a mineral extraction system; and moving the second tool to transfer torque to the housing via the torque transfer coupling to move the first tool between a first position that closes the one or more fluid ports and a second position that opens the one or more fluid ports.

23. The method of claim 22, wherein coupling the second tool to the housing comprises:

coupling a first portion of the second tool to the housing via the rotational coupling; and coupling a second portion of the second tool to the housing via the torque transfer coupling having the first key and slot interface, wherein the first and second portions are configured to move between first and second relative positions, the first and second portions are rotationally coupled in the first relative position, and the first and second portions are rotationally uncoupled in the second relative position.

24. The method of claim 23, wherein the first and second portions are rotationally coupled via engagement of a second key and slot interface in the first relative position, and the first and second portions are rotationally uncoupled via disengagement of the second key and slot interface in the second relative position.

25. The method of claim 22, comprising rotating the second tool to rotate the first tool between the first position and the second position while maintaining a connection of the rotational coupling between the second tool and the housing.

* * * * *